US005578175A

United States Patent [19]

Lin et al.

[11] Patent Number: 5,578,175

[45] Date of Patent: Nov. 26, 1996

[54] PROCESS FOR MANUFACTURING IRIDIUM AND PALLADIUM OXIDES-COATED TITANIUM ELECTRODE AND THE ELECTRODE PRODUCED THEREBY

[75] Inventors: Kwang-Lung Lin; Ju-Tung Lee; Yuan-Po Lee, all of Tainan, Taiwan

[73] Assignee: National Science Council, Taipei, Taiwan

[21] Appl. No.: 291,452

[22] Filed: Aug. 16, 1994

[51] Int. Cl.[6] ..... C25B 11/10; C25D 5/00; C25D 5/18

[52] U.S. Cl. ..... 204/290 F; 205/224; 205/82; 205/83; 205/220; 205/206; 205/210; 205/211; 205/212; 205/103; 205/227

[58] Field of Search ..... 204/290 R, 192.1, 204/192.11; 205/96, 102, 103, 206, 82, 83, 212, 257, 224, 229, 333, 227, 210, 211; 427/123, 725, 126.5, 226, 327, 328, 383.1, 383.7

[56] References Cited

U.S. PATENT DOCUMENTS

| | | | |
|---|---|---|---|
| 3,632,498 | 1/1972 | Beer . | |
| 3,711,385 | 1/1973 | Beer . | |
| 4,584,085 | 4/1986 | Beaver et al. | 204/290 R |
| 4,794,048 | 12/1988 | Oboodi et al. | 428/432 |
| 4,902,388 | 2/1990 | Fornwalt et al. | 204/32.1 |
| 5,066,380 | 11/1991 | Byrd et al. | 204/290 R |
| 5,160,599 | 11/1992 | Kobayashi et al. | 205/106 |

OTHER PUBLICATIONS

J. Electroanal. Chem., vol. 127, 1981, pp. 75–85, B. Beden, et al., "Electrocatalytic Oxidation of Methanol on Platinum–Based Binary Electrodes" no month available.

J. Electroanal. Chem., vol. 92, 1978, pp. 31–43, R. Adzic, et al., "Electrocatalysis by Foreign Metal Monolayers Oxidation of Formic Acid on Palladium" no month available.

Electroanalytical Chemistry and Interfacial Electrochemistry, vol. 45, 1973, pp. 205–231, A. Capon, et al., "The Oxidation of Formic Acid at Noble Metal Electrodes. Part III. Intermediates and Mechanism on Platinum Electrodes" no month available.

Electrochimica Acta, vol. 32, No. 3, 1987, pp. 387–394, P. Ocon, et al., "Electrocatalytic Oxidation of 1,2–Propanediol—I. Behaviour of Platinum Adatom Electrodes in Acid Medium" no month available.

Electrochemical Technology, vol. 5, No. 5–6, May–Jun. 1967, pp. 170–174, L. E. Vaaler, "Graphite–Electrolytic Anodes".

J. Electroanal. Chem., vol. 284, 1990, pp. 465–480, A. Visintin, et al., "Changes in the Surface Morphology of Platinum Electrodes Produced by the Application of Periodic Potential Treatments in Alkaline Solution" no month available.

"Electrodes of Conductive Metallic Oxides," Part B, A. Nidola Technological Impact of Metallic Oxides as Anodes no date available.

J. Electrochem. Soc.: Electrochemical Science and Technology, vol. 128, No. 12, Dec. 1981, pp. 2569–2573, S. Hackwood, et al., "Anodic Evolution of Oxygen on Sputtered Iridium Oxide Films".

Journal of Applied Electrochemistry, vol. 20, 1990, pp. 399–404, R. Le Penven, et al., "Studies of the Electrodeposition of Palladium From Baths Based on $[Pd(NH_3)_2X_2]$ Salts. I. $[Pd(NH_3)_2Cl_2]$ Baths" no month available.

J. Electroanal. Chem., vol. 256, 1988, pp. 199–205, J. Cox et al., "Modification of Glassy Carbon With a Stable Film Containing Iridium Oxide and Palladium" no month available.

J. Electrochem. Soc.: Electrochemical Science and Technology, vol. 130, No. 4, Apr. 1983, pp. 766–769, K. Kang, et al., "Blue Sputtered Iridium Oxide Films (Blue SIROF's)".

J. Electrochem. Soc.: Electrochemical Science and Technology, vol. 131, No. 1, Jan. 1984, pp. 72–77, R. Kotz, et al., "Anodic Iridium Oxide Films".

J. Electrochem. Soc., vol. 136, No. 6, Jun. 1989, pp. 1740–1743, R. Sanjines, et al., "Thermal Stability of Sputtered Iridium Oxide Films".

Electrochimica Acta, vol. 28, 1983, pp. 1–8, J. Mozota, et al., "Surface and Bulk Processes at Oxidized Iridium Electrodes—I. Monolayer Stage and Transition to Reversible Multilayer Oxide Film Behaviour" no month available.

Electrochimica Acta, vol. 28, 1983, pp. 9–16, B. Conway, et al., "Surface and Bulk Processes at Oxidized Iridium Electrodes—II. Conductivity–Switched Behaviour of Thick Oxide Films" no month available.

J. Electrochem. Soc., vol. 136, No. 5, May 1989, pp. 1545–1550, S. Ardizzone, et al., "Effect of the Nature of the Precursor on the Electrocatalytic Properties of Thermally Prepared Ruthenium Oxide".

Journal of Applied Electrochemistry, vol. 19, 1989, pp. 255–262, C. F. Boodts, et al., "Hydrogen Evolution on Iridium Oxide Cathodes" no month available.

J. Electroanal. Chem., vol. 277, 1990, pp. 139–150, G. Lodi, et al., "Microstructure and Electrical Properties of $IrO_2$ Prepared by Thermal Decomposition of $IrCl_3 \cdot x\ H_2O$ Role Played by the Conditions of Thermal Treatment" no month available.

(List continued on next page.)

*Primary Examiner*—Kathryn Gorgos

*Attorney, Agent, or Firm*—Oblon, Spivak, McClelland, Maier & Neustadt, P.C.

[57] ABSTRACT

A process for manufacturing an iridium and palladium oxides-coated titanium electrode comprises preparing a titanium substrate having a surface, applying iridium and palladium to be formed on the surface of the titanium substrate, and heat-treating the iridium and palladium oxides-applied titanium substrate to obtain an iridium and palladium oxides-coated titanium electrode. This invention provides a process for obtaining a coated titanium electrode having therein a good adhesion between the coating material and the titanium electrode, and having an excellent electrochemical stability and a superior catalytic activity in an acidic environment.

35 Claims, 5 Drawing Sheets

OTHER PUBLICATIONS

Journal of Applied Electrochemistry, vol. 21, 1991, pp. 678–682, E. Balko, et al., "Iridium–Tin Mixed Oxide Anode Coatings" no month available.

J. Electroanal. Chem., vol. 281, 1990, pp. 163–170, J. Cox, et al., "Mechanism of the Mediated Reduction of Hydrogen Peroxide at an Electrode Modified With a Film Containing a Basic Form of Iridium Oxide" no month available.

J. Electroanal. Chem., vol. 89, 1978, pp. 397–406, F. Colom, et al., "Anodic Film Formation on Osmium Electrodes in Strong Acid Solutions—I. Voltammetric Studies" no month available.

J. Electrochem. Soc., vol. 136, No. 6, Jun. 1989, pp. 1765–1768, E. M. Kelliher, et al., "Charge Utilization in Anodic Rhodium Oxide Films Pulsed in Carbonate–Buffered Saline".

Materials Science and Technology, vol. 1, Aug. 1985, pp. 613–619, K. Schneider, et al., "Experience With Repair of Stationary Gas–Turbine Blades—View of a Turbine Manufacturer".

Metallurgical Transactions A, vol. 20A, Mar. 1989, pp. 363–371, A. Kar, et al., "Extended Solid Solution and Nonequilibrium Phase Diagram for Ni–Al Alloy Formed During Laser Cladding".

J. Electroanal. Chem., vol. 84, 1977, pp. 117–126, D. Mitchell, et al., "Analysis of the Anodic Oxygen Layer on Iridium by X–Ray Emission, Electron Diffraction and Electron Microscopy" no month available.

Siman et al., Protective and Decorative Coatings for Metals, 1978 pp. 140–141, 149–150, and 160.

PROCESS FOR MANUFACTURING IRIDIUM AND PALLADIUM OXIDES-COATED TITANIUM ELECTRODE AND THE ELECTRODE PRODUCED THEREBY

FIELD OF THE INVENTION

The present invention relates to a process for manufacturing a metal oxide-coated titanium electrode, and more particularly to a process for manufacturing an iridium and palladium oxides-coated titanium electrode.

BACKGROUND OF THE INVENTION

Electrodes are indispensable and of importance in the fields of chemical analysis and electrochemical industries. The development about the material of an electrode for practical application is continuously lasting. A good electrode must possess a superior electric conductivity, an excellent catalytic activity to an chemical reaction expected to occur, and a sufficiently prolonged life-time to be free from being easily spoiled or damaged. An electrode will face much crucial conditions when applied as an anode electrode. In addition to an abrasion caused thereonto by its surrounding solution, the anode electrode will be eroded by oxygen or chlorine gas formed thereon. Furthermore, a pure metal or a graphite anode electrode will be easily worn out by participating by itself in the electrolytic reaction. The lifetime of the electrode is accordingly shortened.

Owing to the possibility of possessing a superior electrochemically catalytic activity, excellent electric conductivity, corrosion durability and chemical inertness, the metal oxide coated electrode has attracted many people's attention for years. After a report that a metal oxide coated electrode was successfully fabricated was revealed in Refs. 1 and 2 by Beer in 1972 and 1973, different types of metal oxide coated electrodes, such as $TiO_2$, $V_2O_5$, $Nb_2O_5$, $MnO_2$, $RuO_2$, $IrO_2$, $SnO_2$, $PbO_2$, etc., were subsequently disclosed. Some of these metal oxide coated electrodes are applied in real electrochemical processes such as saline electrolysis, production of alkali chloride, treatment or recycling of metal-containing waste water, electrochemical synthesis of organic compounds, and decomposition of organic compounds, as disclosed in Refs. 3–6. The above-mentioned metal oxide coated electrodes are affordable to replace the graphite electrode which is apt to be decomposed in a hydrochloric acid solution even being dilute as disclosed in Ref. 7, or the platinum electrode which is used to be dissolved to form a salt in same as disclosed in Ref. 8. Some other metal electrodes, such as Ti, Nb, and Ta electrodes can be another alternatives. However, due to their high costs or their tendency to form inactive films on their surfaces and give rise to their electric resistances so as to weaken the applied current density therethrough, those metal electrodes are still unacceptable in industry.

Iridium, palladium, and their oxides possess an excellent catalytic activity. Iridium oxide has been utilized in an acidic hydro-electrolytic reaction, as disclosed in Refs. 9 and 10. Palladium is always adopted as a catalyst in the chemical industry and has been tried to be coated on platinum and glass carbon, as disclosed in Ref. 11, or co-plated with iridium oxide on glass carbon by an electrochemical process, as disclosed in Ref. 12. The methods for manufacturing an iridium oxide coated electrode have been priorly reported, such as vacuum reactive sputtering as disclosed in Refs. 13–15, constant voltametric cyclic oxidation from pure iridium as disclosed in Refs. 16 and 17, pyrolysis as disclosed in Refs. 18–21, electrochemically cyclic voltametry as disclosed in Refs. 12 and 22–24, plasma fusion as disclosed in Ref. 25, and laser coating as disclosed in Ref. 26, etc. The iridium oxide coated electrode manufactured by any one of the above-mentioned methods except the electrochemical method, is easily damaged due to a non-uniformed grain size distribution on the surface of the obtained electrode, and is likely dissolved in an acid solution when the applied voltage reaches a high value of about 1.6 V with respect to the standard hydrogen electrode so that the iridium oxide coated electrode will be improper as a catalyst under this condition, as disclosed in Ref. 27.

The above-mentioned references are listed as follows and hereinbefore called Ref. 1–27 respectively:

1. H. B. Beer et al., U.S. Pat. No. 3,711,385 (1973).
2. H. B. Beer et al., U.S. Pat. No. 3,632,498 (1972).
3. B. Beden, F. Kadirgan, C. Lamy and J. M. Leger, J. Electroanal. Chem., 127, 75 (1981).
4. R. R. Adzic, M.D. Spasojevic, and A. R. Despic, J. Electroanal. Chem., 92, 31 (1978).
5. A. Capon and R. Parsons, Electroanal. Chem. and Interfacial Electrothem., 45,205 (1973).
6. P. Ocon, B. Beden, H. Huser and C. Lamy, Electrochim. Acta, 32(3), 387 (1987).
7. L. E. Vaaler, Electrothem. Technol., 5, 170 (1967).
8. A. Visintin, W. E. Triaca, and A. J. Arvia, J. Electroanal. Chem., 284, 65 (1990 )
9. A. Nidola, "Electrodes of Conductive Metallic Oxides", S. Trasatti ed., Elesvier, Amsterdam, Chapter 11,627 (1980).
10. S. Hackwood, L. M. Schiavone, W. C. Dautremont Smith and G. Beni, J. Electrochem. Soc., 128(12), 2569 (1981).
11. R. Le Penven, W. Levason and D. Pletcher, J. Appl. Electrochem., 20, 399 (1990).
12. J. A. Cox, S. E. Gadd and B. K. Das, J. Electroanal. Chem., 256, 199(1988).
13. K. S. Kang and J. L. Shay, J. Electrochem. Soc., 130(4), 766 (1983).
14. R. Kotz, H. Neff and S. Stucki, J. Electrochem. Soc., 131 (1), 72 (1984).
15. R. Sanjines, A. Aruchamy and F. Levy, J. Electrochem. Soc., 136(6), 40(1989).
16. B. E. Conway and J. Mozota, Electrochimica Acta, 28, 1 (1983).
17. J. Mozota and B. E. Conway, Electrochimica Acta, 28, 9 (1983).
18. J. C. F. Boodts and S. Trasatti, J. Appl. Electrochem., 19, 255 (1989).
19. G. Lodi, A. D. Battisti, G. Bordin, C. D. Asmundis and A. Benedetti, J. Electroanal. Chem., 277, 139 (1990).
20. E. N. Balko and P. H. Nguyen, J. Appl. Electrochem., 21, 678 (1991).
21. S. Ardizzone, M. Falciola and S. Trasatti, J. Electrochem. Soc., 6(5), 1545 (1989).
22. J. A. Cox and R. K. Jaworski, J. Electroanal. Chem., 281, 163 (1990).
23. F. Colom, J. H. Gonzalez and J. Peinado, J. Electroanal. Chem., 89, 397 (1978).
24. E. M Kelliher and T. L. Rose, J. Electrochem. Soc., 136(6), 1765 (1989).
25. K. Schnider, B, Jahnke, R. Btirgel, and J. Ellner, Mat. Sci. and Tech., 1,613 (1985).
26. A. Kar and J.Mazumder, Metall. Trans. A, 20A, 363 (1969).
27. D. Michell, D. A. J. Rand, and R. Woods, J. Electroanal. Chem, 84, 117 (1977).

The shortages of the prior graphite electrode, metal electrodes, and metal oxide coated electrodes are listed as follows:

1. The anti-corrosive property of the prior electrodes are poor;
2. The prior electrodes are easily oxidized;
3. The catalytic activity of the prior electrodes is unstable and unsatisfactory;
4. The manufacture of the prior electrodes is costly.

It is therefore attempted by the Applicant to deal with the shortages encountered by the prior art.

SUMMARY OF THE INVENTION

An object of the present invention is to offer a process for manufacturing an iridium and palladium oxides-coated titanium electrode having an excellent anti-corrosive property.

Another object of the present invention is to offer a process for manufacturing an iridium and palladium oxides-coated titanium electrode being uneasily oxidized.

Another object of the present invention is to offer a process for manufacturing an iridium and palladium oxides-coated titanium electrode having stable and superior catalytic activity.

Another object of the present invention is to offer a process for manufacturing an iridium and palladium oxides-coated titanium electrode having a lower manufacturing cost.

In accordance with the present invention, a process for manufacturing an iridium and palladium oxides-coated titanium electrode comprises preparing a titanium substrate having a surface, applying an iridium and palladium layer to be formed on the surface of the titanium substrate, and heat-treating the iridium and palladium-applied titanium substrate to obtain an iridium and palladium oxides-coated titanium electrode.

In accordance with the present invention, the step of forming an iridium and palladium layer on the titanium substrate includes a step of immersing the titanium substrate in an iridium and palladium-containing solution to obtain an iridium and palladium-applied titanium substrate.

In accordance with another aspect of the present invention, the iridium and palladium-containing solution comprises a $K_2IrCl_6$ solution, a $PdCl_6$ solution, a $K_2SO_4$ solution and a HCl solution.

In accordance with another aspect of the present invention, the $K_2IrCl_6$, $PdCl_6$, $K_2SO_4$, and HCl solutions have concentrations ranged from about 0.05 mM to about 0.2 mM, from about 0.1 mM to about 0.4 mM, of about 0.2M, and of about 0.1M, respectively.

In accordance with another aspect of the present invention, the iridium and palladium-containing solution has a pH value of about 1.2.

In accordance with another aspect of the present invention, the step for forming iridium and palladium on the titanium substrate is executed by a process selected from a group consisting of electroplating, sputtering, and chemical deposition processes.

In accordance with another aspect of the present invention, the step electroplating process is a cyclic voltametric deposition process and is controlled by a constant potentiometric controller at a proper scanning voltage ranged from about −400 mV to about 950 mV and preferably ranged from about 300 mV to about 900 mV, a proper scanning speed ranged from about 40 mV/sec to about 60 mV/sec and preferably about 50 mV/sec, a proper deposition temperature ranged from room temperature to about 80° C. and preferably about 60° C., and a proper deposition time being at most 4 hours.

In accordance with another aspect of the present invention, the step for preparing the titanium substrate further includes a cleaning step comprises polishing the surface of the titanium substrate by a sand paper, degreasing the titanium substrate in acetone, washing the titanium substrate in a de-ionized distilled water, immersing the titanium substrate in a first acid solution which comprises HF and $HNO_3$ in a molar ratio ranged from 1:3 to 1:4, immersing the titanium substrate in a second acid solution which comprises HF and $H_2Cr_2O_7$ solutions for about 2 minutes wherein the HF solution has a concentration ranged from about 40 g/l to about 60 g/l and preferably being about 55 g/l, and $H_2Cr_2O_7$ solution has a concentration ranged from about 250 g/l to about 300 g/l and preferably being about 290 g/l , immersing the titanium substrate in a third acid solution for about 2 minutes wherein the third acid solution comprises HF and $CH_3COOH$, and rinsing the titanium substrate in a de-ionized distilled water.

In accordance with another aspect of the present invention, the sand paper is selected from a group consisting of No. 80 to No. 1000 sand papers.

In accordance with another aspect of the present invention, the titanium substrate has a dimension of about 20 mm×20 mm×2 mm.

In accordance with another aspect of the present invention, the titanium substrate is further welded thereon a titanium wire.

In accordance with another aspect of the present invention, the heat-treating step is executed in a heat-treating furnace having a furnace temperature wherein the heat-treating step includes a first sub-step of elevating the furnace temperature from a first temperature of about room temperature to a second temperature being from about 400° C. to about 600° C. and preferably about 500° C. at an elevation rate being about 3° C./min to about 6° C./min, a second sub-step of keeping the furnace temperature at the second temperature for about 50 minutes to about 3 hours and preferably about 1 hour, and a third sub-step of lowering the furnace temperature from the second temperature down to a third temperature of about room temperature.

In accordance with another aspect of the present invention, an iridium and palladium oxides-applied titanium electrode comprises a titanium substrate and an iridium and palladium oxides layer deposited to the titanium substrate.

The present invention may be best understood through the following description with reference to the accompanying drawings, in which:

DETAILED DESCRIPTION OF THE PREFERRED EMBODIMENT

Figure 1:
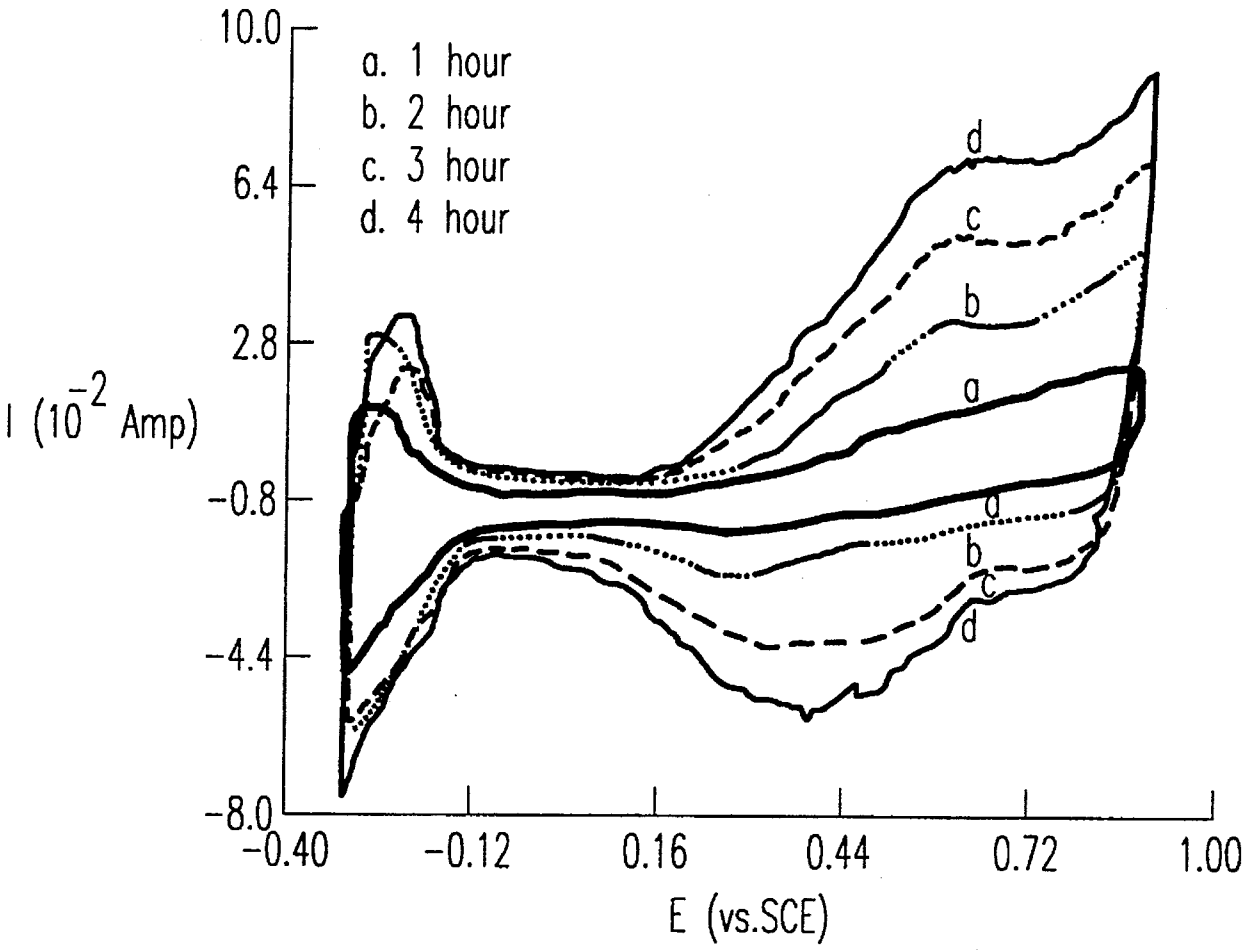
FIG. 1 shows corresponding cyclic voltametric I-E curves of a coated layer with respect to time according to Example 1 of this invention.

Due to the fact that titanium will be easily oxidized in air, the titanium electrode is improper to form a coating thereon by an electrochemical method and thus should be pre-treated before being coated. A titanium substrate having a dimension of 20 mm×20 mm×2 mm after being welded a titanium wire thereon, is polished by a sandpaper selected from No. 80 to No. 1000 sandpapers to remove oxide contaminants on the surface of the titanium substrate. Then the titanium substrate is immersed in an organic solvent, such as acetone, to be oscillated in a ultra-sonic oscillator to clean possibly adhered organic contaminants thereon. Owing to the fact that the cleaned surface of the titanium substrate will immediately form an inactive oxide layer thereon with which will spoil a reactivity and an adhesion of the titanium substrate to the iridium and palladium oxides layer subsequently formed thereon, the thus obtained inactive oxide layer should be destroyed by immersing the titanium substrate into a first hydrofluoric acid-containing solution having hydrofluoric acid and nitric acid in a molar ratio of about 1:3 to 1:4, e.g. 1:3. The titanium substrate is further immersed in a second hydrofluoric acid-containing solution having hydrofluoric acid of about 40–60 g/l , e.g. about 55 g/l , and bichromic acid of about 250–300 g/l , e.g. about 290 g/l , for a relatively short period of time, e.g. about 2 minutes, and is furthermore immersed in a third hydrofluoric acid-containing solution having hydrofluoric acid and acetic acid for a relatively short period of time, e.g. about 2 minutes. The residual acid solutions adhered to the surface of the titanium substrate is washed out by de-ionized distilled water. Through these pre-treating steps, the surface of the titanium substrate is activated. The pre-treated titanium substrate is then subjected to a coating process such as a cyclic voltametric deposition process to obtain an iridium and palladium oxides-coated titanium electrode. The processes, operation conditions, obtained products, and analyzed results of an electrode according to this invention are described in the following examples.

The present invention will now be described more specifically with reference to the following examples. It is to be noted that the following descriptions of examples including preferred embodiments of this invention are presented herein for purpose of illustration and description only; it is not intended to be exhaustive or to be limited to the precise form disclosed.

EXAMPLE 1

Subject a pre-treated titanium substrate to a cyclic voltametric coating chamber having an iridium and palladium-containing solution therein and being controlled by a constant potentiometric controller at a scanning voltage ranged from about –400 mV to about 950 mV, e.g. from about 300 mV to about 900 mV, a scanning speed ranged from about 40 mV/sec to about 60 mV/sec, e.g. about 50 mV/sec, and a deposition temperature ranged from about room temperature to about 80° C., e.g. about 60° C. for a deposition time being at most 4 hours. The iridium and palladium-containing solution includes $K_2IrCl_6$, $PdCl_2$, $K_2SO_4$, and HCl. The concentration of the $K_2IrCl_6$ solution is about 0.05 mM to about 0.2 mM, e.g. about 0.1 mM, that of $PdCl_6$ is about 0.1 mM to about 0.4 mM, e.g. about 0.2 mM, that of $K_2SO_4$ is about 0.2 M, and that of HCl is about 0.1 M. The pH value of the iridium and palladium-containing solution is about 1.2.

The corresponding cyclic voltametric I-E plot of the coated titanium substrate with respect to the deposition time during deposition, as shown in FIG. 1, shows that the area enclosed in a closed I-E curve increases with the deposition time. It is due to the fact that when a deposited layer is continuously growing on the titanium substrate, the outer surface and thus the active area of the deposited layer increase accordingly so that the requirement of the input electric charge is increased. The coated titanium substrate has thereon a deposited layer having poor adhesion to the titanium substrate.

EXAMPLE 2

The coated titanium obtained from the process depicted in Example 1 is further subjected to a heat-treatment in a general heat-treating furnace in atmosphere. The furnace temperature is raised from about room temperature to an elevated temperature being about 400°–600° C., e.g. about 500° C., at an elevation rate of about 3°–6° C./min, e.g. about 3° C./min, then kept at the elevated temperature for a heat-treating time being from about 50 minutes to about 3 hours, e.g. about 1 hour, and placed to be naturally cooled down to about room temperature. The obtained heat-treated deposited layer on the titanium substrate have a good adhesion. If the elevation rate were larger than 6° C./min, the elevated temperature is less than 400° C., or the heat-treating time is less than 50 minutes, the deposited layer would have poor adhesion to the titanium substrate.

Figure 2:
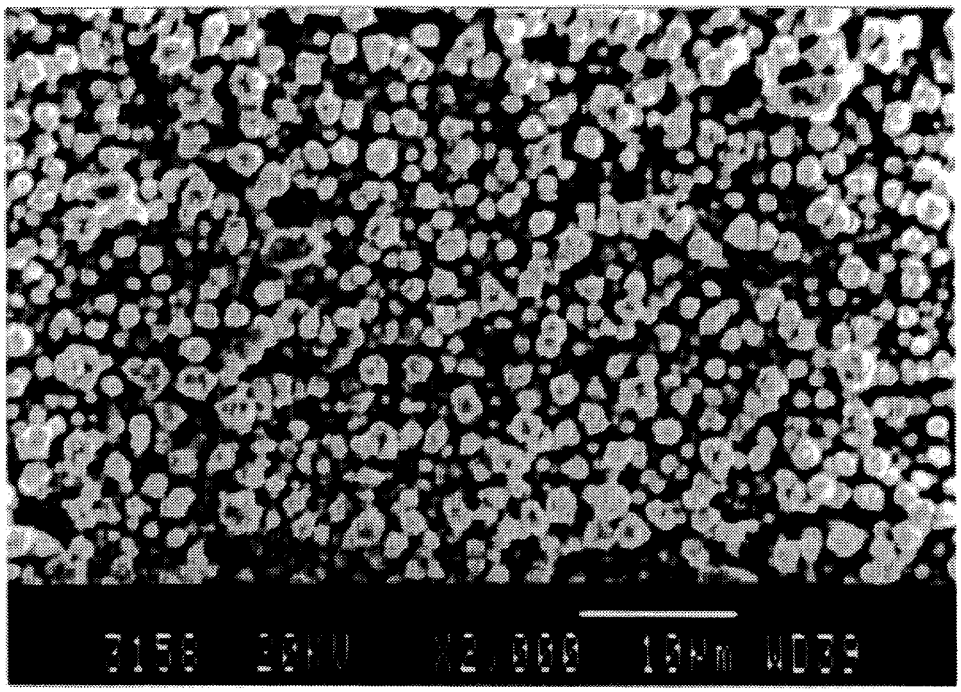
FIG. 2 is an SEM photograph showing a surface of a coated layer of an electrode according to Example 2 of this invention.
Figure 3:
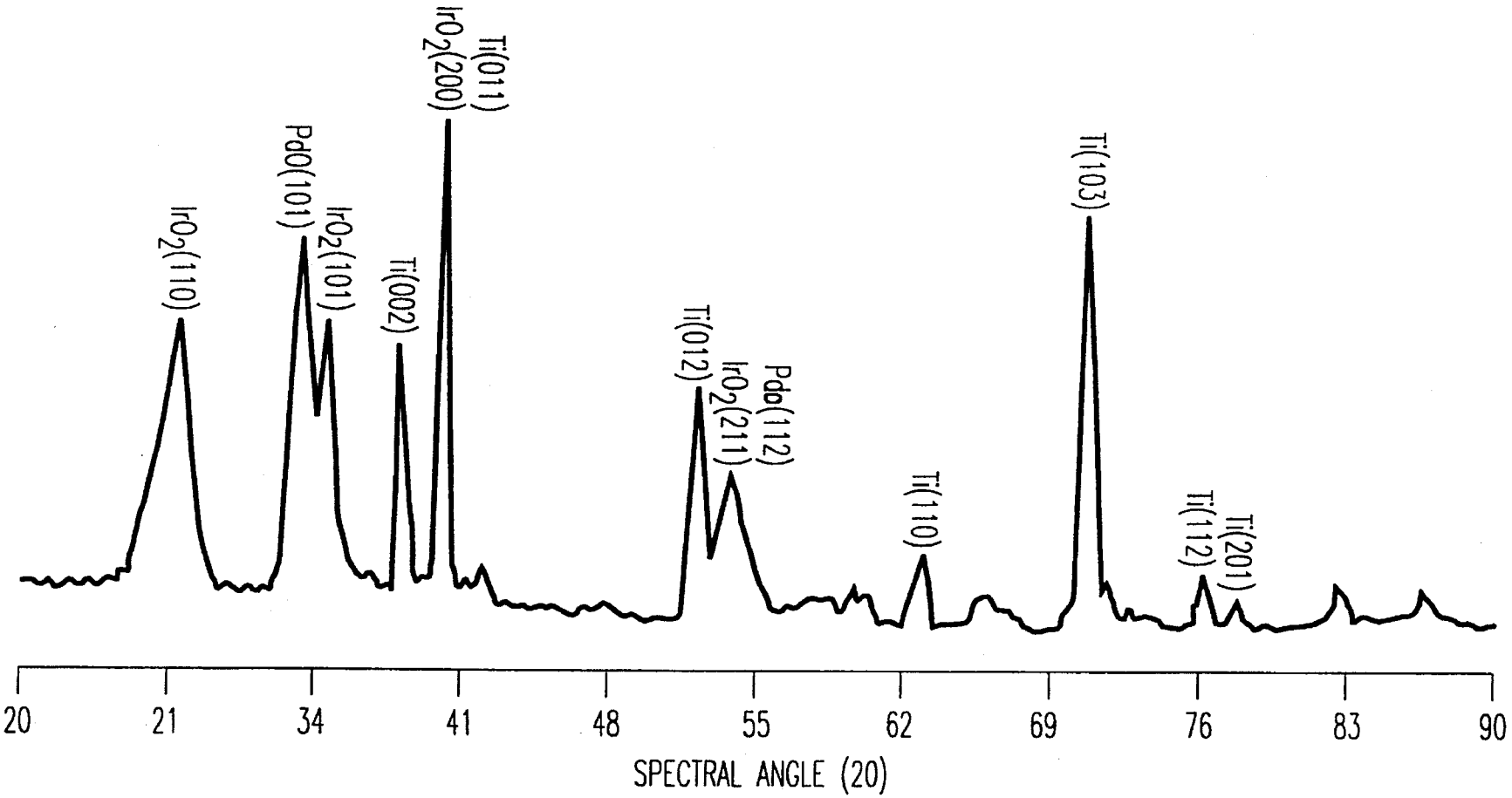
FIG. 3 is an x-ray diffraction spectrum obtained from analyzing a surface of a coated layer of the electrode according to Example 2 of this invention.

The surface of the heat-treated deposited layer on the titanium substrate, as shown in FIG. 2, has a granular configuration, which is different from a smooth appearance an ordinary metal coating usually has, and looks grey or black. Owing to the growing of the granular configuration onto the deposited layer, the coated electrode has a larger active surface area which causes the enclosed area by the closed I-E curve in FIG. 1 to increase with time. When the titanium substrate was coated, the deposited layer is one having metal iridium dissolved in and incorporated with metal palladium. After being heat-treated, the deposited layer having good adhesion to the titanium electrode, as evidenced by an x-ray diffraction specturm as shown in FIG. 3, is a mixed layer including iridium oxide and palladium oxide.

EXAMPLE 3

Figure 4:
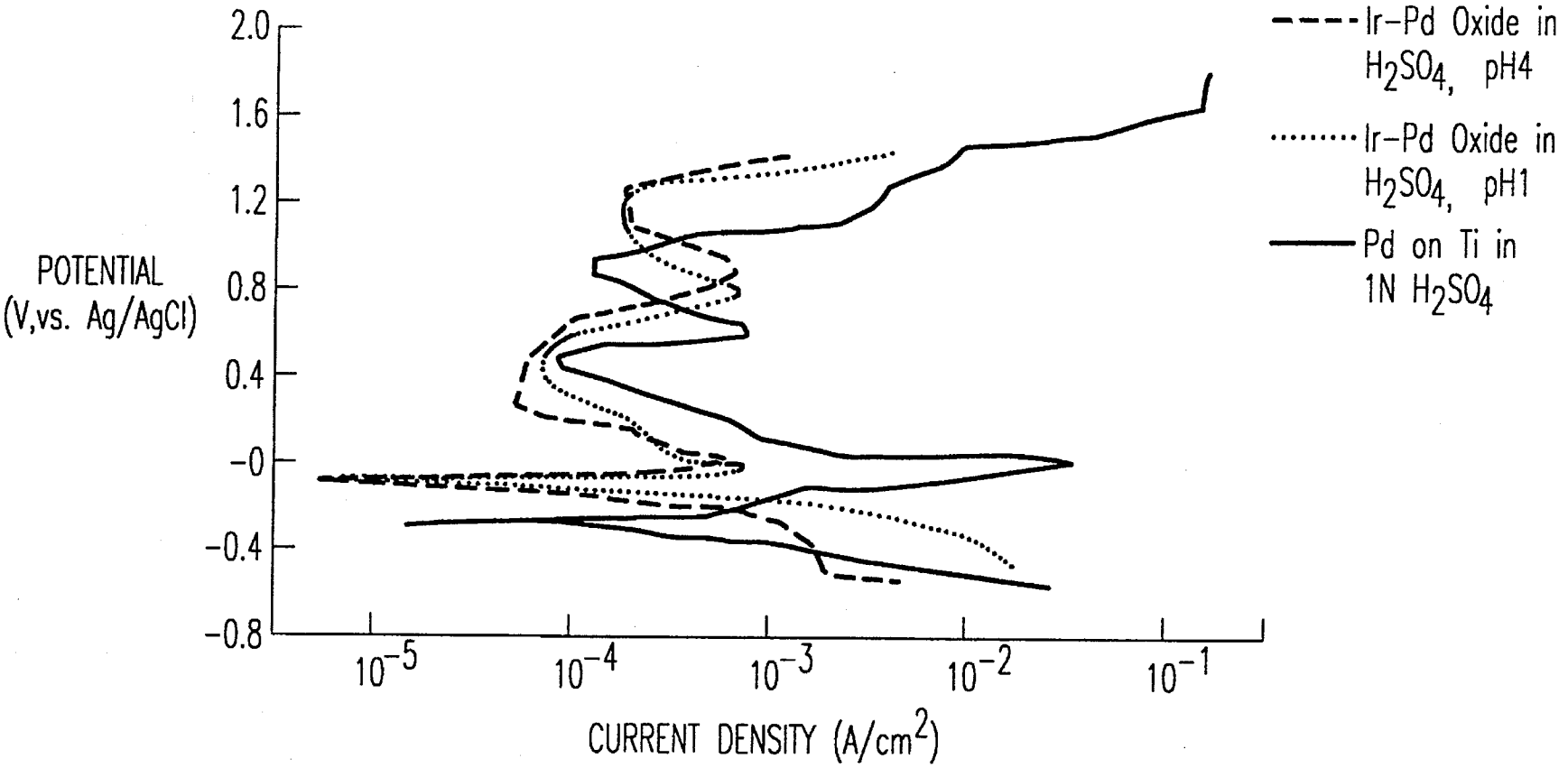
FIG. 4 is a plot of voltage vs. current density obtained from a polarization test executed to an electrode in a sulfuric acid according to this invention.

The obtained iridium and palladium oxides-coated titanium electrode in Example 2 is subject to a polarization test in pH1 and pH4 sulfuric acid solutions to observe its electrochemical characteristic. Its electrochemical characteristic, as shown in FIG. 4, presents an inactive behavior which is similar to that of a palladium-coated titanium electrode. The reason for explaining such a similarity is that when the iridium and palladium oxides-coated titanium is subjected to a reduction potential scanning, some part of the palladium oxide is reduced to a metal palladium and then further oxidized to form two types of oxides thereby. The metal palladium possesses a catalytic activity, and therefore, the oxidation-reduction process benefits the catalytic capability of the coating of the iridium and palladium oxides deposited on the titanium electrode.

EXAMPLE 4

Figure 5:
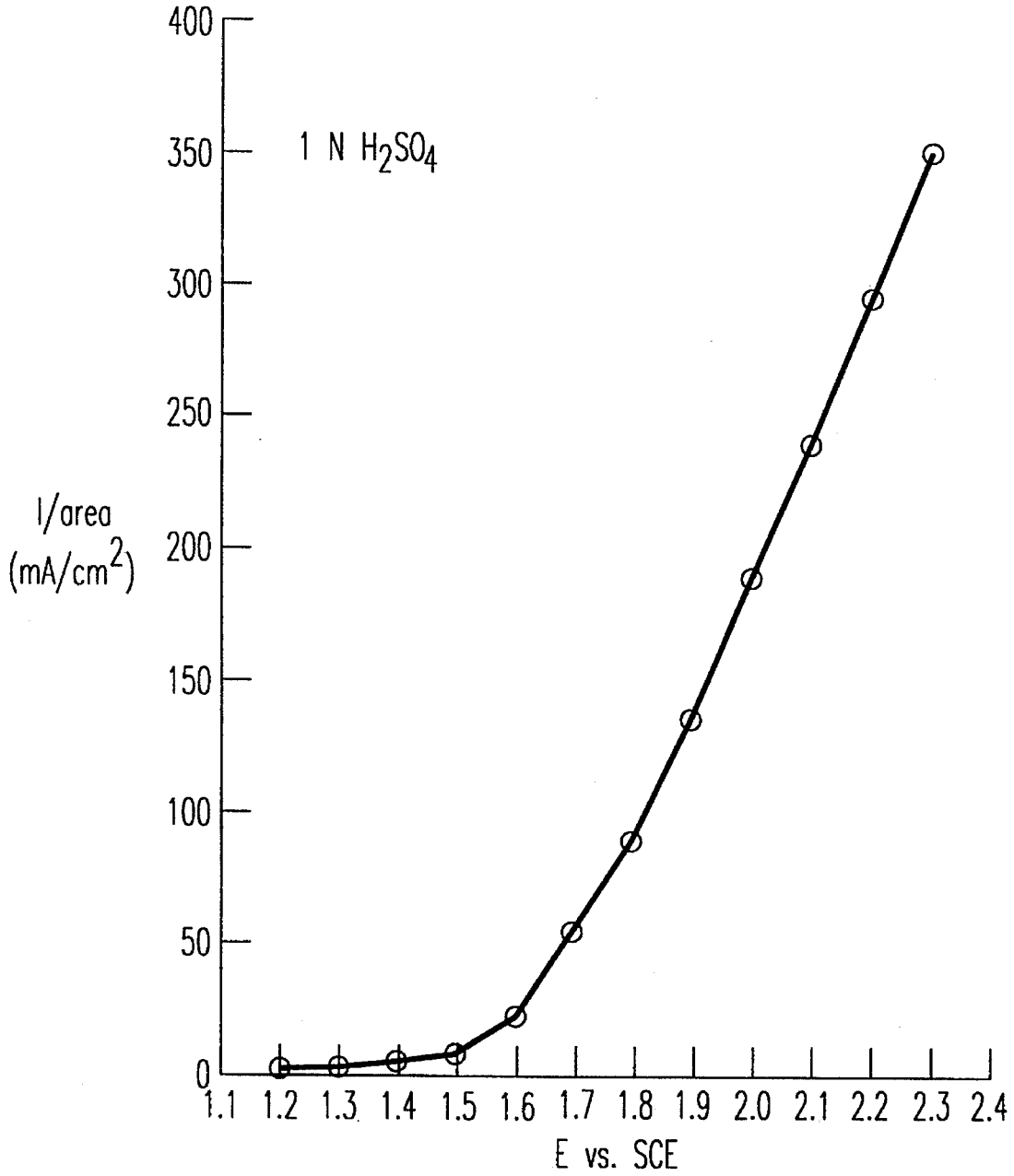
FIG. 5 is a tafel plot obtained from a stability test made to an electrode in a sulfuric acid according to this invention.

The iridium and palladium oxides-coated titanium electrode in Example 2 is further hydro-electrolyzed in a 1N sulfuric acid solution for a stability test. As shown in FIG. 5, a tafel plot obtained thereby shows a curve having a fixed slope of about 0.48 which almost maintains constant before an applied potential reaches about 2.3 V with respect to a standard calomel electrode. Until the potential exceeds a value as high as about 2.3 V, the cracking on the surface of the electrode begins to occur. Therefore, the electrode obtained from this invention keeps its stability in a sulfuric acid having a concentration being at least 1N under a situation of being applied therewith a relatively high potential of about 2.3 V.

According to the aforementioned descriptions, this invention does successfully develop a feasible way to deposit a iridium and palladium oxides layer onto a titanium substrate. The iridium and palladium oxides-coated titanium substrate has excellent electrochemical characteristics and superior stability in an acid environment.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A process for manufacturing iridium and palladium oxides-coated titanium electrode comprising the steps of:

(a) preparing a titanium substrate having a surface;

(b) applying iridium and palladium compounds to said titanium substrate to form an iridium and palladium containing layer by a cyclic voltametric deposition process; and (c) heat-treating said iridium and palladium-applied titanium substrate to obtain an iridium and palladium oxides-coated titanium electrode.

2. A process as claimed in claim 1, wherein said step (b) is executed by immersing said titanium substrate in an iridium and palladium-containing solution to obtain said iridium and palladium containing layer on said titanium substrate by said cyclic voltametric deposition process in said iridium and palladium-containing solution.

3. A process as claimed in claim 2, wherein said iridium and palladium-containing solution comprises a solution of $K_2IrCl_6$, $PdCl_2$, $K_2SO_4$ and HCl.

4. A process as claimed in claim 3, wherein the concentrations of $K_2IrCl_6$, $PdCl_2$, $K_2SO_4$, and HCl in the solution are from about 0.05 mM to about 0.2 mM, from about 0.1 mM to about 0.4 mM, about 0.2M, and about 0.1M, respectively.

5. A process as claimed in claim 2, wherein said iridium and palladium-containing solution has a pH value of about 1.2.

6. A process as claimed in claim 1, wherein said cyclic voltametric deposition process is controlled by a constant potentiometric controller at a scanning voltage, a scanning speed, and a deposition temperature, and is executed for a deposition time.

7. A process as claimed in claim 6, wherein said scanning voltage ranges from about −400 mV to about 950 mV, said scanning speed ranges from about 40 mV/sec to about 60 mV/sec, said deposition temperature ranges from room temperature to about 80° C., and said deposition time is at most 4 hours.

8. A process as claimed in claim 7, wherein said scanning voltage ranges from about 300 mV to about 900 mV, said scanning speed is about 50 mV/sec, and said deposition temperature is about 60° C.

9. A process as claimed in claim 1, wherein said step (a) further includes a cleaning step comprising sub-steps of:

(1a) polishing said surface of said titanium substrate by a sand paper;

(2a) degreasing said titanium substrate in a first liquid;

(3a) washing said titanium substrate in a second liquid;

(4a) immersing said titanium substrate in a third liquid; and (5a) rinsing said titanium substrate in a fourth liquid.

10. A process as claimed in claim 9, wherein said sand paper is selected from a group consisting of No. 80 to No. 1000 sand papers.

11. A process as claimed in claim 9, wherein said first liquid is an organic solvent.

12. A process as claimed in claim 11, wherein said organic solvent is acetone.

13. A process as claimed in claim 9, wherein said second liquid is a de-ionized distilled water.

14. A process as claimed in claim 9, wherein said third solution is a first acid solution.

15. A process as claimed in claim 14, wherein said fourth liquid is a de-ionized distilled water.

16. A process as claimed in claim 9, wherein said first acid solution comprises HF and $HNO_3$.

17. A process as claimed in claim 16, wherein said HF and said $HNO_3$ is in a molar ratio ranged from 1:3 to 1:4.

18. A process as claimed in claim 9, between said steps (4a) and (5a) further comprising a step (4b) of immersing said titanium substrate in an acid solution.

19. A process as claimed in claim 18, wherein said acid solution of step 4(b) comprises HF and $H_2Cr_2O_7$.

20. A process as claimed in claim 19, wherein said HF and $H_2Cr_2O_7$ have concentrations ranged from about 40 g/l to about 60 g/l and from about 250 g/l to about 300 g/l, respectively.

21. A process as claimed in claim 20, wherein said HF and $H_2Cr_2O_7$ have concentrations of about 55 g/l and about 290 g/l, respectively.

22. A process as claimed in claim 18 wherein said step (4b) is executed for about 2 minutes.

23. A process as claimed in claim 18, further comprising a step (4c) of immersing said titanium substrate in an additional acid solution.

24. A process as claimed in claim 23, wherein said additional acid solution of step 4(c) comprises HF and $CH_3COOH$.

25. A process as claimed in claim 23, wherein said step (4c) is executed for about 2 minutes.

26. A process as claimed in claim 1, wherein said titanium substrate has a dimension of about 20 mm×20 mm×2 mm.

27. A process as claimed in claim 1, wherein said titanium substrate includes a titanium wire welded thereto.

28. A process as claimed in claim 1, wherein said step (c) is executed in a heat-treating furnace having a furnace temperature.

29. A process as claimed in claim 28, wherein said step (c) includes a sub-step (1e) of elevating said furnace temperature from a first temperature to a second temperature at an elevation rate.

30. A process as claimed in claim 29, wherein said first temperature is room temperature, said second temperature is ranged from about 400° C. to about 600° C., and said elevation rate is ranged from about 3° C./min to about 6° C./min.

31. A process as claimed in claim 30, wherein said second temperature is about 500° C.

32. A process as claimed in claim 29, wherein said step (c) further includes a sub-step (2c) of keeping said furnace temperature at said second temperature for a first period of time.

33. A process as claimed in claim 32, wherein said first period of time is ranged from about 50 minutes to about 3 hours.

34. A process as claimed in claim 32, wherein said first period of time is about 1 hour.

35. An iridium and palladium oxides-applied titanium electrode manufactured by a process as claimed in claim 1, comprising:

(1) a titanium substrate; and (2) an iridium and palladium oxides layer deposited to said titanium substrate.

* * * * *